United States Patent [19]

Davis

[11] Patent Number: 4,750,243

[45] Date of Patent: Jun. 14, 1988

[54] SHOWER CURTAIN HOLDER

[75] Inventor: Terry L. Davis, New York, N.Y.

[73] Assignee: Waterware Inc., New York, N.Y.

[21] Appl. No.: 790,203

[22] Filed: Oct. 22, 1985

[51] Int. Cl.[4] ..... A43C 11/08

[52] U.S. Cl. ..... 24/231; 24/237; 24/488

[58] Field of Search ..... 24/231, 237, 457, 459, 24/488, 578, 580, 581, 586, 588, 605, 682, 697, 619, 620, 265 AL; 16/108; 248/340, 317

[56] References Cited

U.S. PATENT DOCUMENTS

| | | | |
|---|---|---|---|
| 865,531 | 9/1907 | Robinson | 24/129 A |
| 3,512,223 | 5/1970 | Willinger | 24/298 X |
| 3,706,297 | 12/1972 | Voorhees | 24/237 X |
| 3,889,313 | 6/1975 | Hulthen | 24/488 X |
| 4,049,357 | 9/1977 | Hamisch | 24/459 X |
| 4,114,399 | 9/1978 | Zur | 24/241 S X |

*Primary Examiner*—Kenneth J. Dorner
*Assistant Examiner*—Laurie K. Cranmer
*Attorney, Agent, or Firm*—Marvin S. Gittes

[57] ABSTRACT

An hollow sphere, in accordance with the preferred embodiment of the invention, has a slot formed on a somewhat less than semicircular portion of the great circle that separates the sphere into two hemispheres. A shower curtain grommet support is spaced inwardly of said slot to engage a shower curtain grommet and support a portion of the curtain. A pair of diametrically aligned small circles in the plane of hemispherical separation enables the holder to move freely on a shower curtain rod.

4 Claims, 1 Drawing Sheet

SHOWER CURTAIN HOLDER

BACKGROUND OF THE INVENTION

1. Field of the Invention

This invention relates to shower curtain holders and, more specifically, to an hollow sphere, mountable on a shouwer curtain rod, in which the sphere has a slotted surface adjacent to an internally formed pin for supporting a portion of the shower curtain, and the like.

2. Prior Art

The number of times in which relatively commonplace devices are accepted by the public in spite of years of unsatisfactory service is surprisingly large. Shower curtain holders are illustrative of this group. The usual shower curtain holder is resilient metal or plastic hook, the wide bight of the hook riding on the shower curtain rod. The narrower bight of the hook carries the usual shower curtain grommet and engages the free end of the hook to secure the hook and the supported portion of the shower curtain on the rod.

This structure has a number of significant shortcomings. If the hook is produced from a metal, being exposed frequently to moist conditions, it is subject to an unsightly and damaging corrosive attack, unless a further expensive chrome plating or other corrosion resistant treatment is provided. Having about the same hardness as the shower curtain rod, the hook and the rod often produce a jarring sound whenever the shower curtain is thrust aside or drawn across the opening to the shower stall. Further in this regard, the hook, scraping against the surface of the rod tends to promote corrosive attack on the rod, to give the entire structure a most displeasing appearance. More disturbing, however, it the fact that after showering is finished, the wet surface of the curtain, hanging from an array of hooks, tends to gather into folds that can promote an unsightly growth of mold or accumulation of soap residue. This is, perhaps, a primary reason for the frequent replacement of shower curtains. The exposed grommets on the shower curtain also are a source of dissatisfaction, in that the usual hooks expose the associated grommets to view, creating thereby an aesthetically unpleasing appearance.

A few of these problems have been alleviated to a very limited extent through the adoption of plastic hooks. These plastic hooks nevertheless still fail to overcome the exposed grommet, mold and soap residue problem and produce a similar squeeky and jarring sound when the curtain is drawn across or back. Also both plastic and metal hooks having one contact point on the rod cause not only the jarring sound but also a resistance to movement which causes the operator to tug harder on the end of the curtain, ofter over time causing the plastic grommets or curtain to stretch or tear at the ends.

Accordingly, there is a need for a sturdy, relatively inexpensive shower curtain holder that will not scrape the shower curtain rod or corrode, that glides easily and diminishes risk of tearing the shower curtain and that sustains the shower curtain in a manner that promotes the rapid draining and drying of the wet curtain surface to inhibit mold growth and soap residue accumulation.

BRIEF DESCRIPTION OF THE INVENTION

These needs are, to a large extent, satisfied through the practice of the invention. Typically, an hollow plastic member is divided into two members that are, preferably, approximate halves. Aligned apertures to accommodate the diameter of a conventional shower rod are formed at the division plane for the two halves. A slot also is provided along a portion of the division plane, and a grommet supporting pin is spaced inwardly from the slot in the members.

The two halves are joined together on the shower rod with a shower curtain grommet on the pin or its associated receptacle. The sides of the slot tend to dress, or straighten the adjacent portions of the shower curtain, that is, a length of about 3½" of the curtain are held aligned, counting both sides of the grommet, thereby eliminating, to a large degree, the fluting or folds that are often responsible for mold growth and soap residue accumulation, as well as completely concealing the associated grommet from view.

The plastic construction of the members also tends to eliminate jarring noises and the corrosion promoting scraping that takes place when the shower curtain and its attached holders are moved. This friction caused by other types of hooks imposes a greater effort to pull the curtain from side-to-side and thereby, over time, causes damage to the curtain. Certainly, the improved appearance provided through this invention not only by the lack of corrosion, mold and soap residue, but also by the visually more pleasing effect of the hollow members and major reduction in the unpleasant sound effects and strain on the curtain grommets are important features of the invention.

For a more complete appreciation of the invention, attention is invited to the following detailed description of a preferred embodiment, taken with the features of the drawing. The scope of the invention, however, is limited only through the claims appended hereto.

DESCRIPTION OF THE PREFERRED EMBODIMENT

Figure 1:
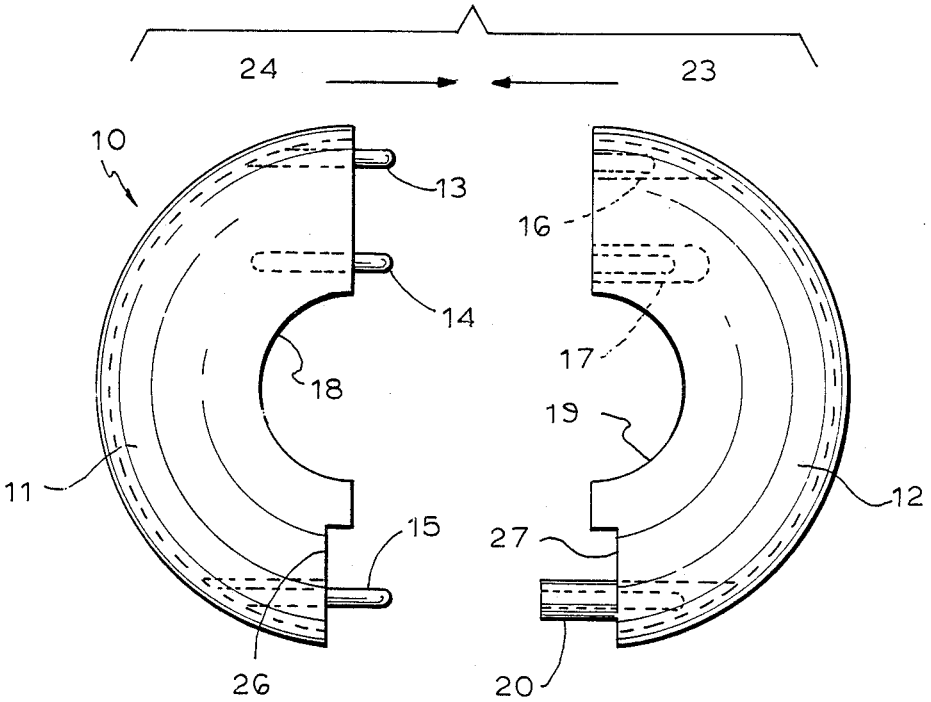
FIG. 1 is an exploded assembly view of a side elevation of a typical embodiment of the invention.

For a more detailed understanding of the invention, attention is invited to FIG. 1 which shows an hollow, spherical member 10. Although the illustrative member 10 in the preferred embodiment is a sphere, any suitable shape, of which a cube, or the like is exemplary, can be used in accordance with the principles of the invention. The spherical member 10 is divided along a great circle into a male half 11 and a female half 12. The male half has three protruding locking pins, of which only pins 13 and 14 are shown in the drawing, the third pin (not shown) being blocked from view in FIG. 1 projection by the pin 14.

Small circles, apertures or aperture portions, formed in part by semicircular bights 18, 19 in the respective halves 11, 12 each are somewhat larger in diameter than the outside diameter of a conventional shower rod (not shown in the drawing). Also not shown in the drawing is a companion set of semicircular bights, each in a respective one of the halves 11, 12 and diametrically aligned with the corresponding bights 18, 19.

The protruding locking pins 13, 14 and a similarly protruding grommet support pin 15 (as well as the third locking pin that is not shown) each are aligned with bores or recesses formed in pin receptacles of which only the locking pin receptacles 16, 17 and the grommet support pin receptacle 20 are shown in the drawing. Preferably, to hold the halves 11, 12 together in an environment of expansion and contraction caused by heat and steam, as well as to permit the halves to be assembled and disassembled without causing the pins 13, 14, 15 to break, it has been found that the three pins (of which only the pins 13, 14 are shown) should protrude about 1" beyond the great circle plane of the hemisphere 11 and that the grommet support pin 15 should protrude about 1¼" in the same direction.

Figure 2:
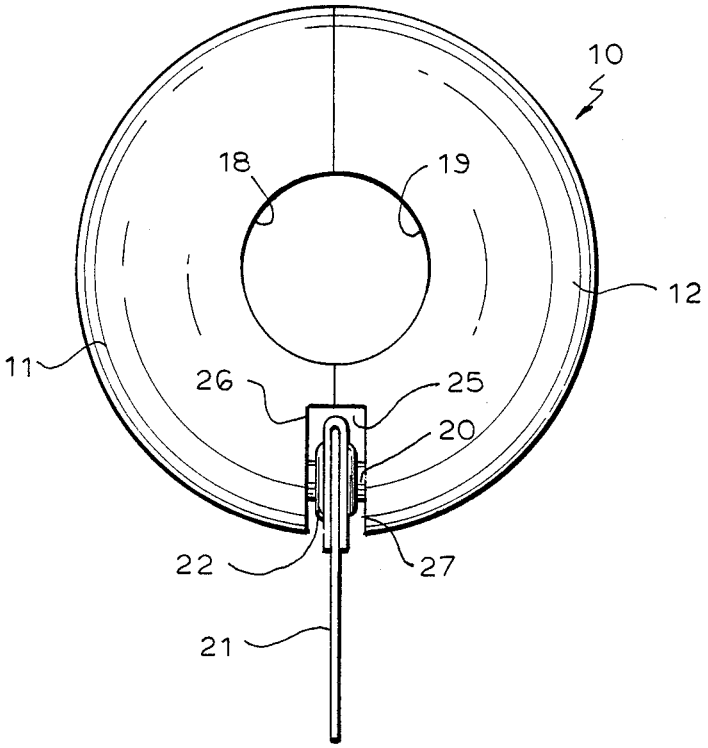
FIG. 2 is an assembly view of the embodiment of the invention shown in FIG. 1.

It should be noted that, in accordance with a salient feature of the invention, the grommet or shower curtain hanger aperture support receptacle 20 protrudes well beyond the plane that separates the spherical member 10 into the two hemispherical halves 11, 12. Preferably, the length of the protrusion for the receptacle 20 is at least equal to the combined widths of recessed sides 26, 27 which form an arcuate slot 25 (FIG. 2) in the plane of the great circle that separates the hemispherical members 11, 12.

Ordinarily, the slot 25 should extend along the circumference of the great circle for only slightly less than a full semicircle, with the grommet receptacle 20 in alignment with the center of the spherical member 10 and the midpoint of the arc of the slot 25.

In operation, the halves 11, 12 are aligned on opposite sides of a shower curtain rod (not shown) so that each of the pins 13, 14, 15 will be received with its respective one of the receptacles 16, 17, 20. A shower curtain grommet or hanging aperture 22 (FIG. 2) and its associated shower curtain portion 21 is mounted on the grommet support pin receptacle 20. The two halves 11, 12 (FIG. 1) are moved together in the directions of respective arrows 24, 23 until the entire assembly snaps shut with the pins 13, 14 15 each nested securely within the bore formed in its respective one of the receptacles 16, 17, 20. The grommet 22 and the shower curtain 21 are supported by the grommet support receptacle 20, the sides 26, 27 of the slot 25, dressing the shower curtain out flat for at least the 3¼" of containment by each of the members 11,12 largely eliminate the fluting and folds that heretofore inhibited the drainage and drying of the curtain's surface.

The member 10 is formed, preferably, by injection molded plastic technique and, for this purpose, it has been found that a plastic identified as PETG, sold under the tradename KODAR by the Eastman Kodak Company of Rochester, N.Y., provides the best combination of cost, desirable production characteristics and product durability thus constituting a major feature of the invention. General purpose polypropylene also has been found to be suitable if the member 10 is to have opaque color characteristics from color mixed in the pre-injected plastic. While both of the plastics were finally chosen for cost and their inherent properties of flexibility, durability and the like, the design of the locking pins and therefore the mold had to provide internal supporting structure to counteract the inherent elasticity of the materials. A fine balance had to be struck between best design and plastics for smoothest operation and lowest possible breakage.

Thus, there is provided a device that not only conceals the grommet from view, as well as to eliminate a principal source of mold growth and soap residue accumulation, but also avoids a main cause of scraping and corrosion and the jarring sound in pulling the curtain back and forth, besides largely eliminating the stress that often is applied to the end shower curtain grommets. This is accomplished, moreover, through a structure that can be manufactured inexpensively in any number of pleasing shapes, colors being either added to the plastic prior to molding, or applied after the molding is finished.

I claim:

1. A shower curtain holder comprising first and second hollow member means configured to be joined along an interface about a shower curtain rod and a shower curtain hanging aperture, at least one of said first and second hollow member means having first and second aligned aperture portions proximate to said interface, said first and second aligned aperture portions defining first channel means extending along an axis parallel to said interface for accepting therein a portion of a shower curtain rod and contacting and accepted portion of a shower curtain rod at first and second peripheral positions bounded by said first and second aligned aperture portions, at least one of said first and second hollow member means having second channel means extending parallel to said first channel means along said axis, said second channel means also extending from a location at said interface to a surface of one of said first and second hollow member means, said second channel means for accepting a portion of a shower curtain containing a shower curtain hanging aperture, locking pin means extending from one of said first and second hollow member means and recess means associated with another of said first and second hollow member means, said recess means being disposed to receive said locking pin means when said first and second hollow member means are joined and inhibiting rotation of said first and second hollow member means with respect to one another, and a shower curtain aperture pin extending from one of said first and second hollow member means, said shower curtain aperture pin being associated with said second channel means and disposed to extend across said second channel means transversely to said axis, said shower curtain aperture pin being sized to accept a shower curtain hanging aperture thereon and said second channel means being dimensioned with respect to said shower curtain aperture pin to dress portions of a shower curtain adjacent to a shower curtain hanging aperture.

2. The shower curtain holder according to claim 1 wherein said first and second hollow member means each take the general form of hemispheres.

3. The shower curtain holder according to claim 1 wherein said locking pin means includes a plurality of individual locking pins and said recess means includes a plurality of recesses formed in projections extending toward said interface from said another of said first and second hollow member means, each of said plurality of recesses being disposed to receive respective ones of said plurality of locking pins.

4. The shower curtain holder according to claim 1 wherein said recess means includes a recess in an extending portion of said shower curtain aperture pin and said locking pin means includes a locking pin extending from said another of said first and second hollow member means, said locking pin being disposed to be received in said recess when said first and second hollow member means are joined.

* * * * *